United States Patent [19]

Boshco

[11] 4,149,442

[45] Apr. 17, 1979

[54] METAL SURFACED ELECTRIC GUITAR

[76] Inventor: Nikolas K. Boshco, 213 Cottage Grove, Santa Barbara, Calif. 93101

[21] Appl. No.: 806,319

[22] Filed: Jun. 13, 1977

[51] Int. Cl.[2] ..... G10H 3/08

[52] U.S. Cl. ..... 84/1.15; 84/1.16

[58] Field of Search ..... 84/1.04, 1.14–1.16, 84/DIG. 24

[56] References Cited

U.S. PATENT DOCUMENTS

| | | | |
|---|---|---|---|
| 2,020,557 | 11/1935 | Loar | 84/1.16 |
| 3,291,888 | 12/1966 | Meazzi et al. | 84/1.16 |
| 3,911,777 | 10/1975 | Rendell | 84/1.16 |

*Primary Examiner*—Stanley J. Witkowski

*Attorney, Agent, or Firm*—Spensley, Horn, & Lubitz

[57] ABSTRACT

A metal surface electric guitar is described which incorporates a metal plate attached to the solid body of the electric guitar, this plate overlying a hollow area in the body beneath the strings of the guitar. At least one electric pickup is attached to the portion of the plate over the hollow area in the solid body. Thus, the electrical signal produced by this pickup includes both components produced by the vibrating strings and components produced as a result of the resonance of the metal plate over the hollow area, this combination producing a unique sound. While the pickup may be positioned between the plate and the strings, it also may be located within the hollow area of the body if desired.

10 Claims, 3 Drawing Figures

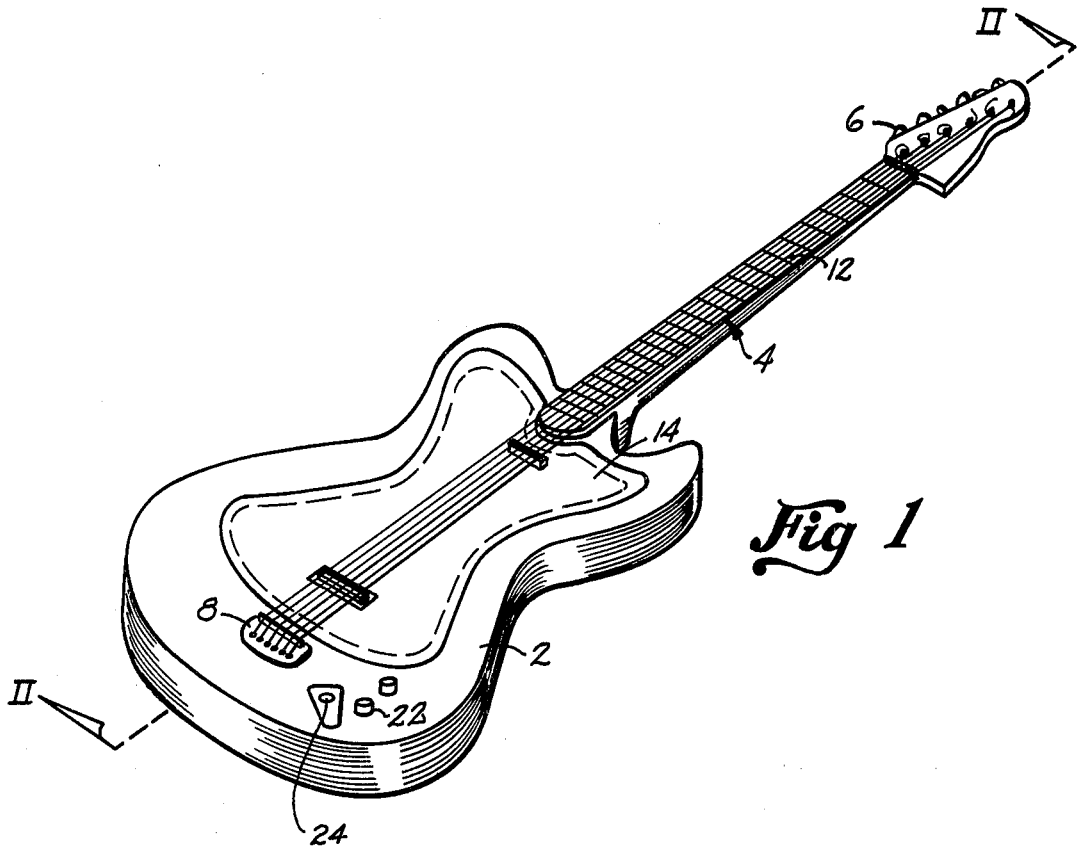
Fig 1
Fig 2
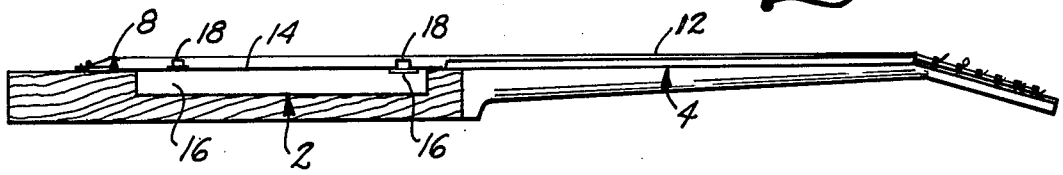
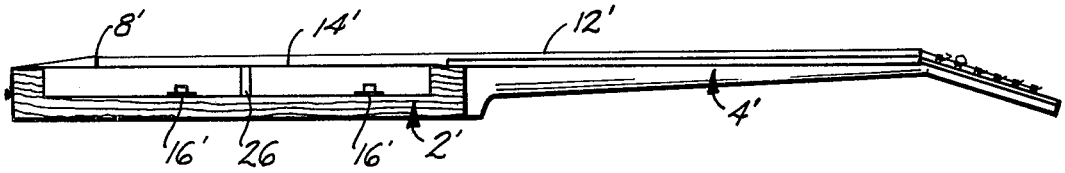
Fig 3

METAL SURFACED ELECTRIC GUITAR

BACKGROUND OF THE INVENTION

This invention relates to a metal surfaced electric guitar.

A musical instrument is known by its tone; in fact, tone is everything. There are numerous guitar designs, each producing a slightly different tone. Generally there are two basic types of guitar, a hollow-bodied, thin shell, resonant guitar, such as the classic Spanish guitar, and a solid-bodied guitar, such as an electric guitar. The hollow-bodied guitar depends largely for its tone and volume on the resonance within and of the hollow body produced by the vibrating strings. The electric guitar, on the other hand, depends largely for its tone and volume upon the interaction of the vibrating strings with the magnetic field produced by a pickup positioned under the strings. Generally the hollow-bodied guitar produces a softer, mellower tone, whereas the solid body electric guitar produces a crisper, brighter tone, one of longer duration. Because of these differences, the classic hollow-bodied guitar is preferred for "Spanish" or flamingo music performances, whereas the electric guitar is preferred for country blues and rock 'n roll music.

Innumerable variations of these two general guitar structures have been devised, all in an attempt to achieve a new, pleasing tone. Various pickup locations have been employed on electric guitars, again to obtain different tonal qualities. Electric pickups have been added to hollow-bodied guitars for the same reason.

An object of this invention is to achieve an electric guitar with a new, distinct, brighter tonal quality. This and other objects will be apparent to those skilled in the art from the following description of a preferred embodiment of the invention.

SUMMARY OF THE INVENTION

The new electric guitar disclosed herein is a modified form of the conventional structure, a structure which includes a solid body, a neck attached to the solid body, a bridge resting on the solid body, and a plurality of steel strings attached to the neck and extending across the neck and bridge of the solid body, the strings being attached to the solid body. The body includes a hollow area underlying the strings. A metal plate is attached to the body and covers this hollow area. At least one electric pickup responsive to the vibrations of adjacent steel strings to produce a corresponding electric signal is attached to the metal plate at the hollow area, the hollow area being substantially larger than the pickup. Thus, vibrations of the strings induce vibrations in the metal plate over the hollow area, which vibrations modulate the electric signal produced by the pickup, resulting in a new, distinct, clearer, crisper brighter tone. A plurality of pickups may be employed, each preferably being attached to the metal plate over the hollow area. Alternatively, the pickups may be positioned with the hollow area in the body underlying the plate. The bridge may be located either on the metal plate or the solid body, as desired. An isolating block may be included in the hollow area to separate it into a multiplicity of chambers, each having an associated pickup.

BRIEF DESCRIPTION OF THE DRAWINGS

The invention will be further described in connection with the accompanying drawings in which:

FIG. 1 is a perspective view of a preferred construction of the new electric guitar;

FIG. 2 is a longitudinal cross-sectional view taken on lines II—II of FIG. 1; and FIG. 3 is a cross-sectional view similar to FIG. 2 of another embodiment of the electric guitar.

DETAILED DESCRIPTION OF THE INVENTION

By building and testing a variety of different guitar structures, it has been discovered that providing a hollow area with a solid guitar body, this hollow being covered by a metal plate to which an electric pickup is attached, produces a new, bright, resonant, crisp, and unique tone. Of course, there are a variety of constructions possible for such a guitar, all of which will incorporate this unique relationship of elements. Two different preferred constructions are shown in the drawings. Many others will be apparent to those skilled in this art. For that reason, while such constructions are illustrated in the drawings are preferred by the inventor, since the teachings presented in this application will suggest many other constructions to those skilled in this art, the scope of the invention is not limited to these disclosed constructions, but rather is defined by the claims.

As shown in FIG. 1, a preferred construction of the new electric guitar includes a solid body 2, usually of wood, and a neck 4, the neck bearing turning machines 6. A bridge 8 is attached to the body. A plurality of strings 12 are attached to the turning machines 6, and extend over the neck 4 and the bridge 8, to which they are attached. A metal plate 14 is securely attached to the body beneath the area of the body over which the strings pass. Preferably this plate is 20 gauge steel, and may be plated with aluminum, copper, nickel, silver, gold or other metals as desired.

As shown in FIG. 2, at least one hollow area 16 is provided in the solid body underlying the strings. The metal plate over-lies and extends beyond this hollow area. Various electric pickups 18 of conventional construction are attached to the metal plate, the pickups generally being centered over the hollow area.

When one or more of the strings on the guitar are plucked, they vibrate to effect the magnetic field produced by the electric pickup, this variation being translated by the pickup into an electric signal in a conventional manner. The vibrating string also appears to cause metal plate 14 to resonate somewhat. This resonance or effect has been found to significantly effect the tonal quality of the electrical signal produced by the electric pickup, presumably because the vibrations are transmitted by the plate to the electric pickup to vary somewhat its spacing from the vibrating string. The resulting tone is quite distinct, being much brighter, crisper, more penetrating and resonant than the ordinary electric guitar and offering excellent tonal contrast with other, conventional guitar constructions.

A plurality of pickups 18 may be provided on the guitar, each being positioned over a hollow area 16 as shown in FIGS. 1 and 2. One pickup is positioned closer to the bridge and produces a very crisp, bright sound, whereas another pickup is positioned closer to the neck and produces a somewhat softer, mellower yet still distinct tone. Electrical controls 22 are provided on the body of the guitar to vary the volume of the signal produced by the respective pickups and to permit these respective signals to appear as an output signal at jack 24, all in a conventional fashion.

The electric pickups may be positioned between the plate and the vibrating strings, as is the pickup next to the bridge in FIG. 2, or an opening may be provided in the plate and the pickup mounted under the plate with its pole pieces projecting through the opening to a position adjacent to the vibrating strings as is the pickup next to the neck in FIG. 2. In either case, the pickups are attached to the plate over the hollow area in the body of the guitar. Thus, the vibrating plate over the hollow area will modulate their tone to produce a unique and pleasing sound. Of course, only one of these pickups may be mounted over the hollow area, the other pickup being mounted on the solid wood body to produce a tone quite like that produced by a conventional electric guitar.

It has been found that the pickups may be mounted not to sense mainly the vibrations of the strings, as shown in FIGS. 1 and 2, but rather to sense mainly the vibrations of the metal plate. Such a construction is illustrated in FIG. 3, in which body 2' includes a hollow area 16' which underlies the strings and extends from under the bridge 8' to adjacent the neck 4'. Preferably at least one dampening or isolation block 26 is provided in the hollow area, this block being wedged between the plate 14' and the solid body 2'. When one or more strings 12' of the guitar are plucked, they will induce vibrations in the metal plate 14'. The electric pickups 16' are attached to the solid body of the guitar with their pole pieces underlying, and spaced from the metal plate 14'. Thus, when one or more of the strings 12' of the guitar are plucked, they will set up vibrations in the metal plate 14' which vibrations will be sensed by the electric pickups 16'. The dampening block 26 serves to isolate and separate the tonal qualities produced by the two pickups, one on either side of the dampening block. The tonal quality produced by this construction differs from that produced by the constructions shown in FIGS. 1 and 2 in that it is noticably softer and mellower.

I claim:

1. An electric guitar including a solid body, a neck attached to the solid body, a bridge resting on the body portion, a plurality of steel strings attached to the neck and extending across the neck and bridge on the body, means attaching the strings to the solid body, and at least one electric pickup attached to the guitar and positioned to respond to the vibrations of the steel strings to produce a corresponding electric signal, the improvement comprising:

(a) a hollow area in the body underlying the strings, the hollow area being substantially larger in lateral and longitudinal dimensions than the electric pickup, (b) a metal plate attached to the body and covering the hollow area, the thickness of the metal plate and the size of the hollow area being such that the plate resonates to vibrations of the steel strings, (c) means attaching the pickup to the guitar with the pickup being positioned relative to the hollow area at a location of appreciable vibrations of the metal plate, whereby vibrations of the strings induce vibrations in the metal plate over the hollow area, which vibrations modulate the electric signal produced by the pickup.

2. An electric guitar as set forth in claim 1 in which the hollow area underlies and extends from the bridge to adjacent the neck, the metal plate covering the hollow area, the guitar including a plurality of electric pickups, the pickups being attached to the metal plate, each over the hollow area and underlying the strings.

3. An electric guitar as set forth in claim 1 including a plurality of pickups, said attachment means attaching each pickup to the guitar at a position relative to the hollow area at a location of appreciable vibrations of the metal plate, a dampening block in the hollow area bearing on both the metal plate and the solid body and being positioned between adjacent pickups to assist in separating and isolating the tonal qualities produced by the pickups.

4. An electric guitar as set forth in claim 1 in which the electric pickup is attached to the plate and positioned between the plate and the strings.

5. An electric guitar as set forth in claim 1 in which the pickup is positioned in the hollow area between the plate and the body.

6. An electric guitar as set forth in claim 1 in which the metal plate includes an opening over the hollow area and in which the pickup includes a pole piece projecting through the opening in the metal plate to a position adjacent the strings.

7. An electric guitar as set forth in claim 1 in which the pickup includes a pole piece which underlies the metal plate and senses the vibrations of the metal plate, the plate being formed of a material which will effect a magnetic field.

8. An electric guitar as set forth in claim 1 in which the hollow area underlies the strings and extends from adjacent to the neck to and beyond the bridge, the metal plate overlying all of the hollow area, the bridge bearing on the metal plate, the pickup being attached to the solid body of the guitar and positioned to underly the plate and sense vibrations in the plate, the plate being formed of a material which will effect a magnetic field.

9. An electric guitar as set forth in claim 8 including a plurality of pickups each underlying the strings, and a dampening block in the hollow area bearing on both the metal plate and the solid body and being positioned between adjacent pickups to assist in separating and isolating the tonal qualities produced by the pickups.

10. An electric guitar as set forth in claim 1 in which the bridge is positioned to rest upon the metal plate, the vibrations of the strings being transmitted through the bridge to the metal plate.

* * * * *